US009993932B2

(12) United States Patent
Salamone

(10) Patent No.: US 9,993,932 B2
(45) Date of Patent: Jun. 12, 2018

(54) ROTARY CUTTER

(75) Inventor: John Salamone, Kinnelon, NJ (US)

(73) Assignee: Vits International, Inc., Blauvelt, NY (US)

( * ) Notice: Subject to any disclaimer, the term of this patent is extended or adjusted under 35 U.S.C. 154(b) by 0 days. days.

(21) Appl. No.: 13/609,247

(22) Filed: Sep. 10, 2012

(65) Prior Publication Data

US 2013/0118328 A1 May 16, 2013

Related U.S. Application Data

(60) Provisional application No. 61/533,184, filed on Sep. 9, 2011.

(51) Int. Cl.

| | |
|---|---|
| ***B26D 1/10*** | (2006.01) |
| ***B26D 1/40*** | (2006.01) |
| ***B26D 5/20*** | (2006.01) |
| *B26D 5/34* | (2006.01) |
| *B26D 7/26* | (2006.01) |

(52) U.S. Cl.

CPC ..... *B26D 1/405* (2013.01); *B26D 5/20* (2013.01); *B26D 5/34* (2013.01); *B26D 2007/2664* (2013.01); *Y10T 83/4838* (2015.04)

(58) Field of Classification Search

CPC ..... B26D 7/2614; B26D 2007/2607; B26D 1/626; B26D 7/2628; B26D 7/2635; B26D 1/405; B26D 5/20; B26D 5/26; B26D 5/28; B26D 5/38; B26D 1/40; B26D 7/26; B26F 1/384; B23D 25/12; Y10T 83/483; Y10T 83/4838

USPC ..... 83/343, 331, 346, 347, 285–288, 295, 83/298, 299

See application file for complete search history.

(56) References Cited

U.S. PATENT DOCUMENTS

| | | | | |
|---|---|---|---|---|
| 4,420,999 | A * | 12/1983 | Hirakawa | B26D 1/626 83/343 |
| 4,452,114 | A * | 6/1984 | Rynik | B26D 7/1863 83/100 |
| 5,398,575 | A * | 3/1995 | Rewitzer | 83/72 |
| 5,720,210 | A * | 2/1998 | Okahashi | 83/342 |
| 5,740,709 | A * | 4/1998 | Boston et al. | 83/308 |
| 5,773,745 | A * | 6/1998 | Widmer | 89/1.11 |
| 6,086,694 | A * | 7/2000 | Winter | G09F 5/04 118/669 |
| 6,161,458 | A * | 12/2000 | Spatafora | B26D 7/2628 83/13 |
| 6,694,850 | B1 * | 2/2004 | Tosatto | 83/337 |
| 6,772,663 | B2 * | 8/2004 | Machamer | B26D 7/20 83/37 |
| 6,971,295 | B2 * | 12/2005 | Teshima | B65H 29/12 271/188 |
| 7,503,245 | B2 * | 3/2009 | Miyazawa | G01N 1/06 83/13 |

(Continued)

*Primary Examiner* — Jennifer Swinney
*Assistant Examiner* — Richard Crosby, Jr.
(74) *Attorney, Agent, or Firm* — Leason Ellis LLP

(57) ABSTRACT

A rotary cutter system for cutting a web of material being feed into the rotary cutter at a press speed that includes a cutting cylinder, an anvil cylinder and a servo motor. The rotary cutter includes a controller that controls the speed of rotations of the cylinders. Control of the speed of cutting and anvil cylinders allows for the adjustment of the cut length of the material without having to adjust the position of knives in the cutting cylinder.

3 Claims, 11 Drawing Sheets

(56) References Cited

U.S. PATENT DOCUMENTS

| | | | | |
|---|---|---|---|---|
| 7,594,461 | B2 * | 9/2009 | Aichele | B26D 7/22 83/344 |
| 9,474,302 | B2 * | 10/2016 | White | A24B 7/12 |
| 2004/0060464 | A1 * | 4/2004 | Birkenfeld | B23K 26/0846 101/226 |
| 2005/0247174 | A1 | 11/2005 | Scheffer et al. | |
| 2008/0028902 | A1 * | 2/2008 | Baggot | B26D 1/626 83/13 |
| 2010/0275751 | A1 * | 11/2010 | Zeuschner | A01J 27/04 83/13 |
| 2012/0000333 | A1 * | 1/2012 | Hatcher | B26D 1/225 83/52 |

* cited by examiner

ROTARY CUTTER

CROSS-REFERENCE TO RELATED APPLICATION

This application claims the benefit of U.S. Provisional Application No. 61/533,184, filed Sep. 9, 2011, which is hereby incorporated by reference herein in its entirety for all purposes.

FIELD OF THE INVENTION

The present invention relates to equipment used in the processing of material (e.g. web material), and, more particularly, to a rotary cutter.

BACKGROUND OF THE INVENTION

Rotary cutters are used in the printing industry to sever and perforate, as the case may be, moving web materials such as paper. Incisions are generally made transverse to the direction of web travel, and serve to separate the web into discrete predetermined lengths or create tear lines at predetermined locations along the length of the web. A rotary cutter typically comprises a pair of synchronized counter-rotating knife and anvil cylinders between which the web passes. The knife cylinder is equipped with one or more knife blades (or knives) that generally extend parallel to the rotational axis of the knife cylinder, and cut or perforate the web against the anvil cylinder. In known web-type printing press operations that produce a printed product from a moving paper web, the printed product may pass through other auxiliary equipment performing additional operations before being forwarded to the rotary cutter. A single knife blade can be mounted to the knife cylinder to produce what has been termed a butt cut in web material. Mounting a pair of knife blades circumferentially adjacent each other produces what has been termed a bleed cut, resulting in a trim piece or chip being formed that must be discarded.

Because the circumference of a knife cylinder is fixed, the lengths of the segments into which a web can be cut are varied by changing the circumferential locations of multiple knife blades mounted to the knife cylinder, resulting in multiple cuts being produced in the web with each revolution of the knife cylinder. Rotary cutters designed to be reconfigurable for processing various different products are referred to as variable product rotary cutters, or simply variable rotary cutters. Virtually all variable rotary cutters utilize knife holders (or knife blocks) that house the knife blades. "Make-ready" is a term of art that is understood to mean the process of setting up a rotary cutter by mounting knife holders to a knife cylinder before running a job.

One configuration of a variable rotary cutter employs knife holders mounted to the knife cylinder by a dovetail lock-up design in the surface of the cylinder face. In another configuration, multiple tapped holes are formed in the surface of the cylinder face to clamp knife holders onto the cylinder. Knife holder sizes are matched to the lengths of the knife blade with which they are to be used, and knife blades are mounted in their respective holders off the cutting machine. During make-ready, the operator must know the format of the finished product including the final product length, the number of product streams that will simultaneously pass through the rotary cutter, and the width of each stream. In addition, it is important to know where these streams will be relative to the centerline (axial midpoint) of the cylinder, i.e., left or right of the centerline. Two product streams side-by-side with widths of less than 12 inches (about 30 cm) are most common, in which case two 12-inch holders, each carrying a 12-inch knife blade, would be used.

Once the above information is retrieved, the knife holders are mounted in the strategic locations both circumferentially and axially on the cylinder surface to produce the desired products. Proper positioning of the knife holders requires a locating device and indexing of the cylinder. The knife cylinder is rotated until a location at which a knife blade is required is accessible to the operator. A knife holder (with a mounted knife blade) is placed on the cylinder and its location precisely determined with the locating device. The holder is then secured to the cylinder, after which the cylinder is again indexed to the next location requiring a knife blade. This process is repeated for each knife holder, resulting in a very tedious and time-consuming process.

When the particular job is finished and a new job with a different product format is to be run, all of the knife holders are removed from the cylinder and the entire process is repeated. On occasion, the product lengths might be the same from job to job, however the product stream width and/or location (left or right) often differ, requiring the holders to be removed and remounted left or right to line up with the printed streams.

In other rotary cutters, the knife cylinder has a plurality of knife holders circumferentially positioned about the circumference of the knife cylinder. At least some of the knife holders extend the axial length of the knife cylinder and are configured to permit multiple knife blades of different lengths to be mounted therein end-to-end across the entire axial length of the knife cylinder. At least one knife blade can be mounted in at least a first of the knife holders, while knife blades are not mounted in at least a second of the knife holders so that rotation of the knife cylinder against a web material forms incisions spaced apart a first spacing distance in the web material. Thereafter, the knife cylinder can be reconfigured without repositioning any of the knife holders on the knife cylinder, but instead by removing, repositioning, and/or installing knife blades on the knife holders. An example of such a device can be found in U.S. Patent Application Publication No. 2005/0247174 to Scheffer, et al., which is incorporated by reference herein in its entirety.

As discussed above, typical rotary cutters include two cylinders that rotate relative to each other. Knife blades are mounted to one cylinder and the other cylinder acts as an anvil that provides a surface against which to sandwich the web material between the knife blade to perform the cut.

SUMMARY OF THE INVENTION

In one aspect of the invention, a rotary cutter system for cutting a web of material being feed into the rotary cutter at a press speed. The cutter includes a cutting cylinder supported for rotation about an axis. At least one knife is mounted on the cutting cylinder and extends radially therefrom. An anvil cylinder is supported for rotation parallel to the axis and positioned such that the at least one knife contacts the anvil cylinder at a cutting position in which each knife is perpendicular to the anvil cylinder. At least one servo motor that rotates the cutting cylinder and the anvil cylinder. A controller that includes a processor and memory and executing software that configures the processor to control the speed of rotation of the anvil cylinder and the cutting cylinder by controlling the at least one servo motor between a first speed that is equal the press speed of the web that is passed between the cutting and anvil cylinders at the cutting position, thereby cutting the web that is disposed between the cutting and anvil cylinders, and a second speed in which the web passes between the cutting and anvil cylinders without being cut, wherein speed of rotation of the anvil cylinder and the cutting cylinder controls the length of a cut in the web of material. In a further aspect, the cutter includes two mounting walls and wherein the cutting cylinder is supported between the two mounting walls for rotation about the axis.

BRIEF DESCRIPTION OF THE FIGURES

FIG. 9 is a side view of the cutter along the B direction of FIG. 8;

DESCRIPTION OF CERTAIN EMBODIMENTS OF THE INVENTION

As discussed above, typical rotary cutters include two cylinders that rotate relative to each other. Knife blades are mounted to one cylinder and the other cylinder acts as an anvil that provides a surface against which to sandwich the web material between the knife blade to perform the cut.

Figure 1:
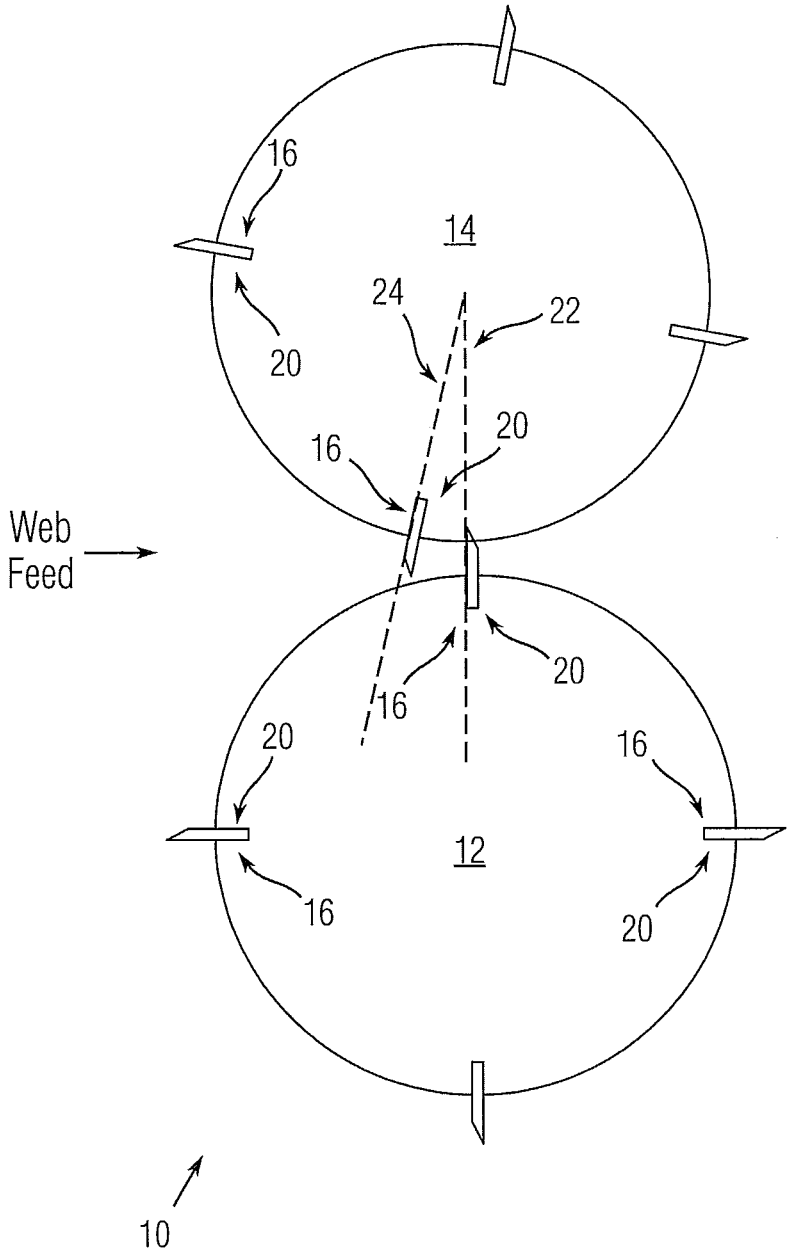
FIGS. 1-5 illustrate rotation of two cutting cylinders are various points through their rotation positions.

Referring to FIG. 1, the rotary cutter 10 includes two cylinders 12 and 14. Each cylinder 12 and 14 includes a plurality of knife blades 16. The knife blade 16 can have a chisel shaped tip (e.g., angled tip) that provides the cutting surface. The knives are received and secured in apertures 20 that hold the knives 16 perpendicular to their respective cylinders. The bottom cylinder 12 is slightly out of phase with top cylinder 14, as can be seen by dashed lines 22 and 24. Accordingly, as the cylinders rotate with respect to each other, the knives contact the other cylinder in alternating fashion. In FIG. 1, the blade 16 is contacting a portion of the top cylinder 14 in area of the cylinder that does not have a blade. Therefore, a web (not show) that is being feed between the cylinders would be cut by the knife of the bottom cylinder. As the cylinders continue to rotate the knife from the top cylinder will contact the bottom cylinder to perform a second cut. The distance between cuts defines the length of the item cut from the web. Accordingly, by adjusting the rotation phase of the top cylinder relative to the bottom cylinder, the length of the cut item can be easily adjusted without repositioning the knives on the rotary cylinder.

Figure 2:
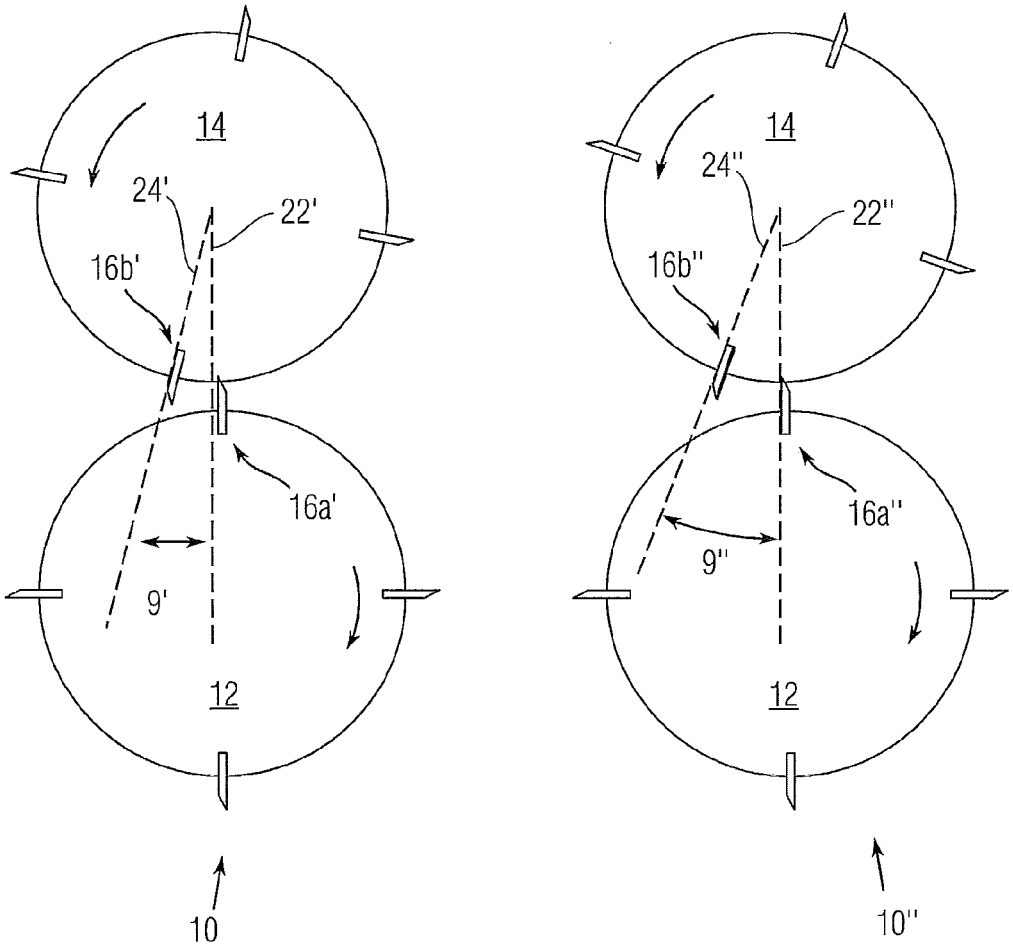
Figure 3:
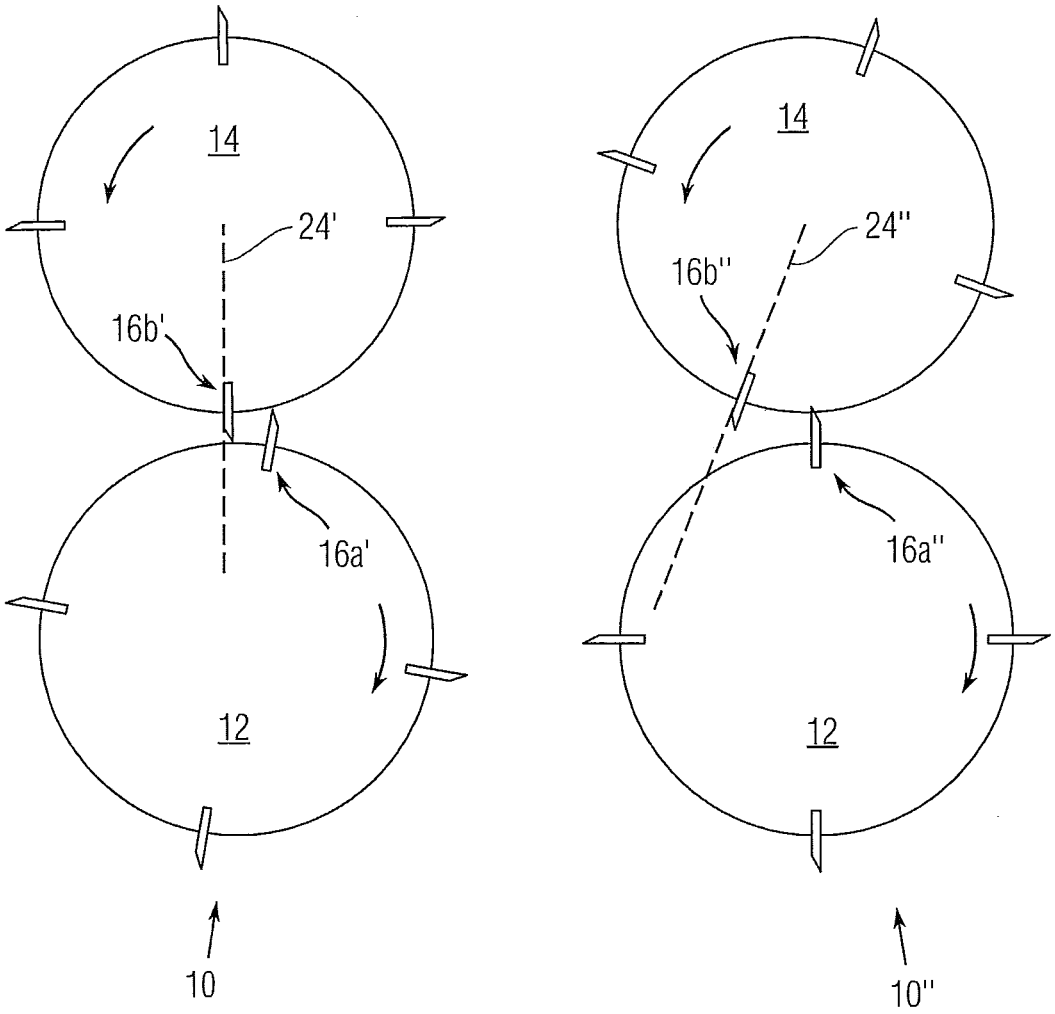
Figure 4:
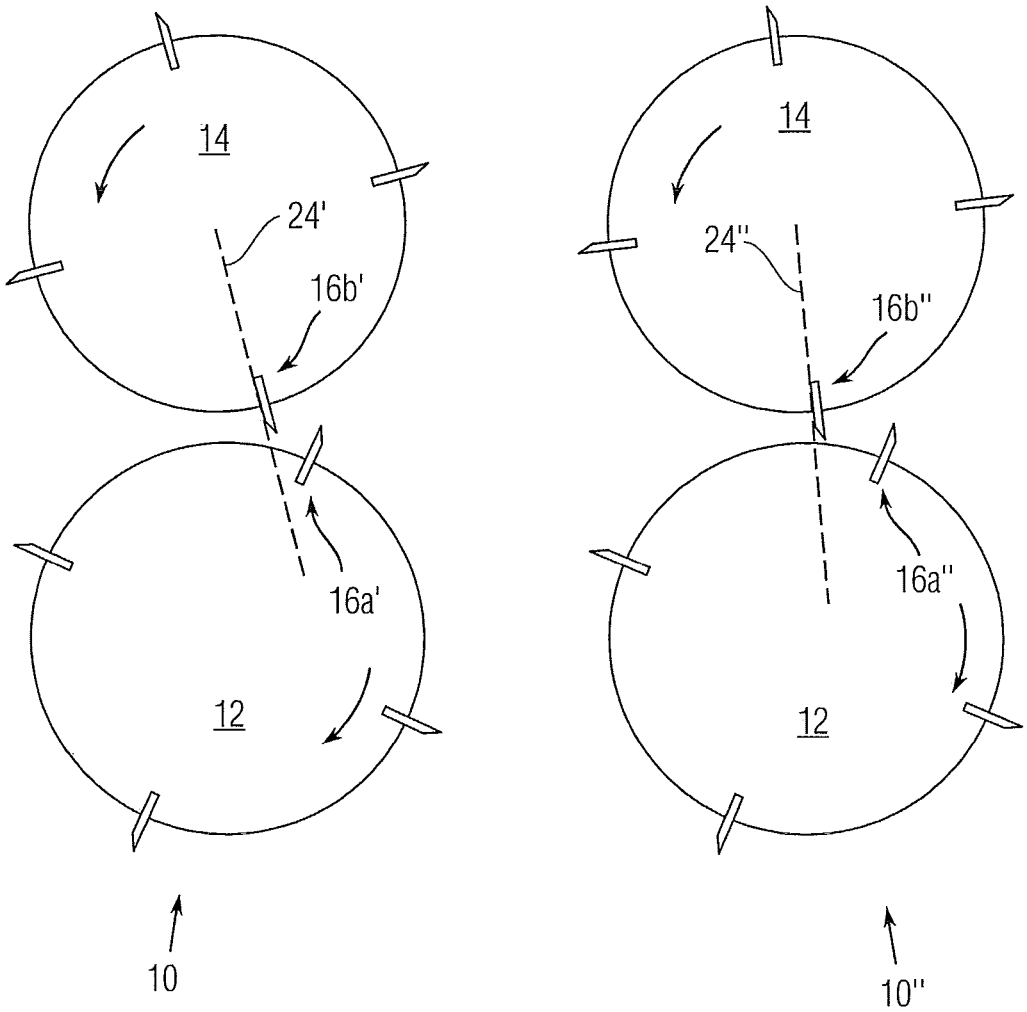

FIGS. 2-5 show a side by side comparison of two rotary cutters that are out of phase by differing amounts and the effect that has on the cutting of the web as the cylinder rotate. Rotary cylinder set 10" is out of phase more as compared to set 10'. Accordingly, angle a" is greater than a'. As such, the item cut from the web by set 10' will be short than an item cut by set 10". In FIG. 2, both bottom blades **16*a*' and 16*a*" cut the web in this position. As can be seen in FIG. 3, in a further rotary position the top blade 16*b*' of set 10' has made a cut in the web. However, because set 10" is out of phase by a greater amount, top blade 16*b*" has not yet rotated into position to make the second cut in the web. At the point illustrated in FIG. 4, top blade 16*b*" has made the cut in the web, but no cutting is occurring with set 10'**.

Thus, providing knives on top and bottom cylinders of a rotary cutter, the length of the cuts can be adjusted by adjusting the phase between the two cylinders. More particularly, by setting the phase difference between the top and bottom cylinders, size of the piece of the web material that is cut between the bottom knife contacting the top cylinder and the top knife contacting the bottom cylinder can be controlled. The piece of web material is the trim piece or chip. Thus, the chip size can be adjusted by adjusting the phase difference between the top and bottom cylinders, without having to adjust the positioning of the knives.

Figure 5:
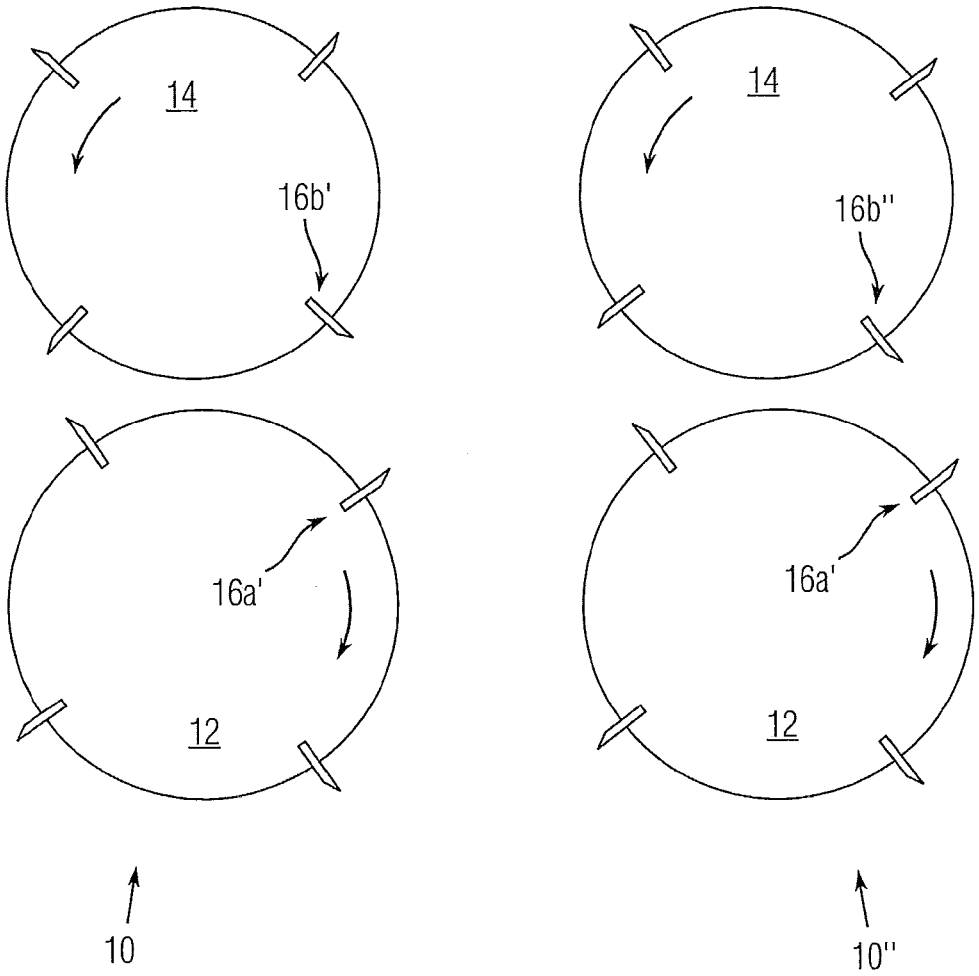

Furthermore, adjusting the speed of rotation of the cylinder results in an adjustment of the piece of web material that is cut. As can be seen in FIG. 5, neither the top or bottom knives are contacting either cylinder. In this state, the web material continues to pass between the two cylinders. Thus, if the cylinders are set to rotate slowly, more web material can pass between the cylinders before the next knife contacts and makes a cut. If the cylinders are rotating quickly, less web material can pass between the cylinders, resulting in smaller web pieces being cut.

Accordingly, controlling the speed of the two cylinders (e.g., using computer control) the size of the size of the cuts can be adjusted as required by the particular job.

Accordingly, an easy and efficient means of adjusting the cutting length and chip size—by adjusting rotation speed and/or phase—for different cut and manufacturing procedures is provided.

Figure 6:
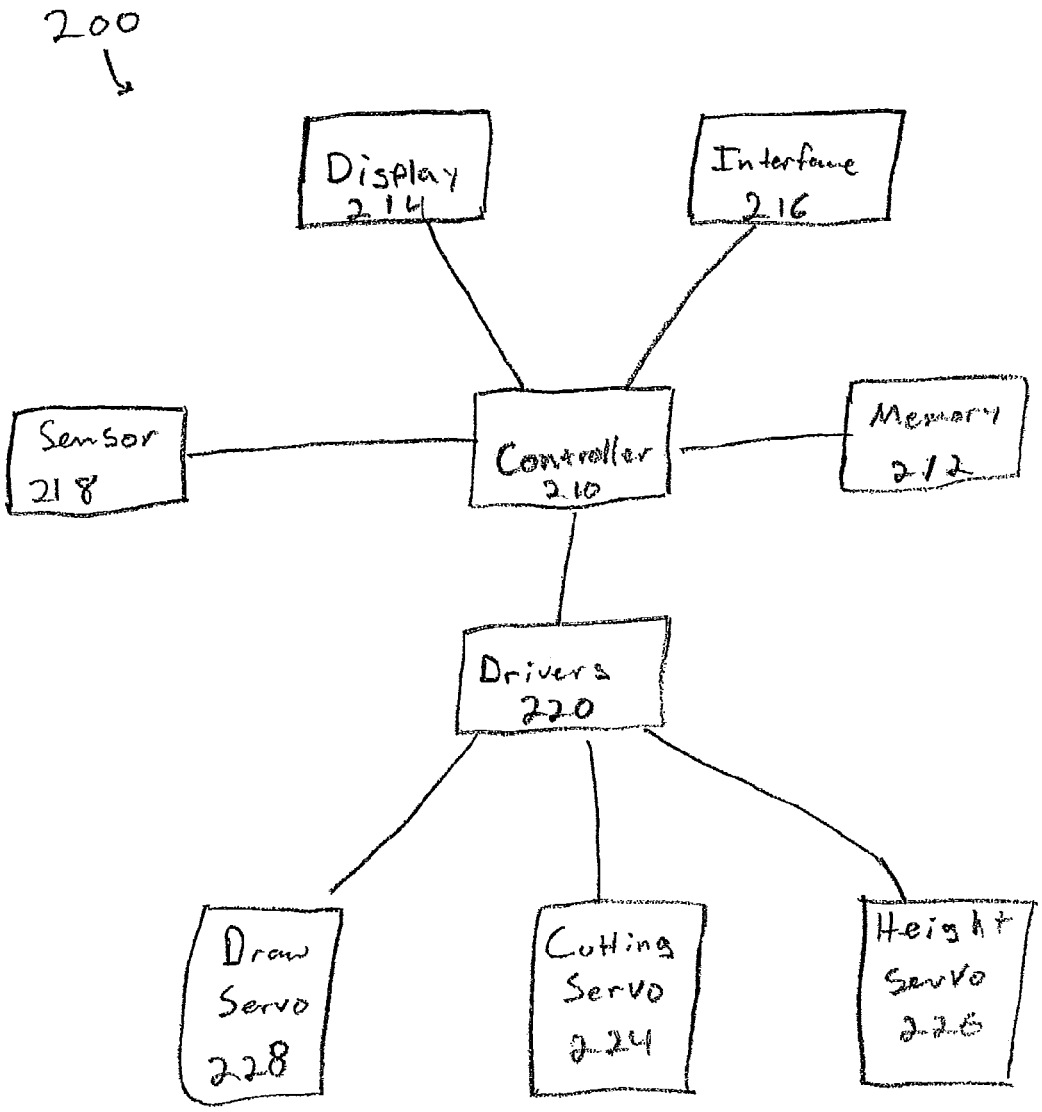
FIG. 6 is a diagram showing the control system of the cutter.
Figure 7:
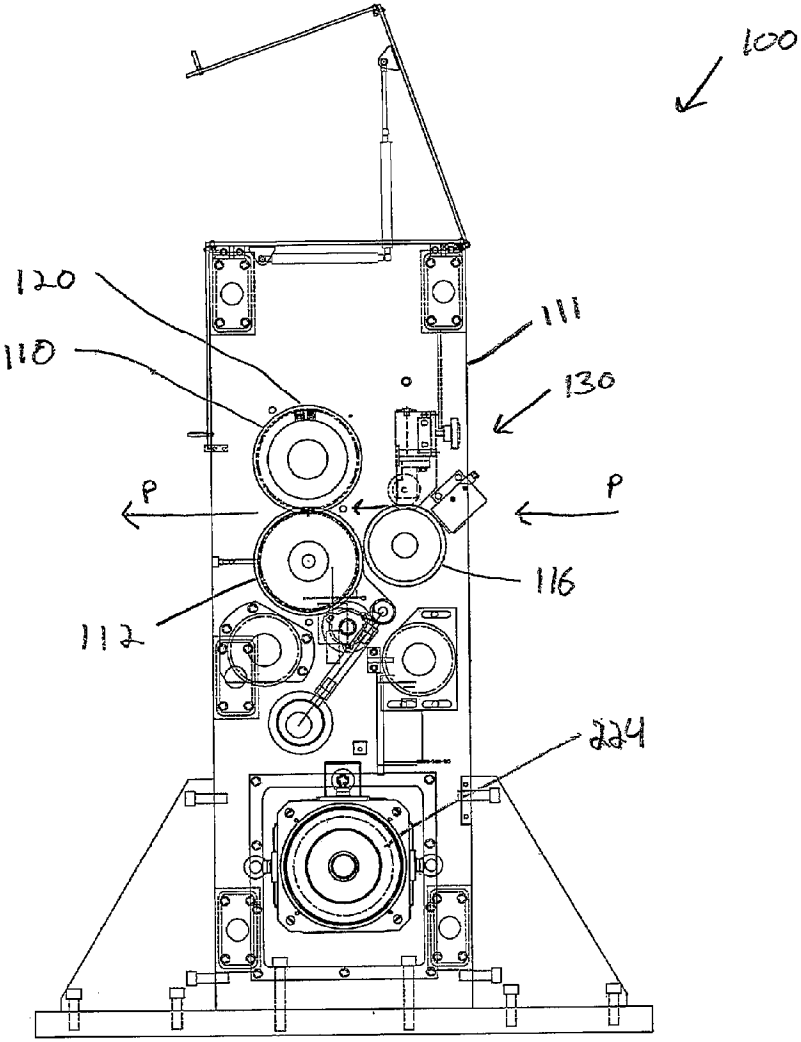
FIG. 7 is a side view of the cutter along the A direction of FIG. 8.

FIGS. 6 and 7 shows a rotary cuter 100 and a control system 200 that controls the operation of the rotary cutter 100. The rotary cuter 100 is designed to cut a long web of material, e.g., a spool of paper, into specific length sheets. The material can be stored on a spool and feed through a printing press system upstream of the cutter 100 that applies graphics to the paper. After the graphics have been applied, the stream of material from the press, shown with arrows P, is feed through the cutter 100 to be cut, as discussed in more detail below. The rotary cutter 100 includes a plurality of servo motors and rotating cylinders supported between a pair of mounting walls 111, 113, as discussed in more detail below.

The control system 200 of the rotary cutter 100 includes a controller 210 and a memory 212 that can store software modules that are executed on the processor of the controller 210. A display 214 and an interface 216 allow for the operator to input settings, such as the thickness of the material to be cut, length of the cut to be made in the material, the number of knives that are in the machine, etc. The interface and display can be a touch screen-type interface and display. The control 210 receives these variables and, through the software, determines how to control the various motors that will be discussed more detail below. The controller 210, through the drivers 220, sends electrical signals to the various motors, such as the cutting servo motor 224, the height control motor 226, and the draw servo motor 228. In addition, the controller 210 receives signals from sensors 218 that provide information concerning the current feed of the material to be cut. For example, sensor 218 can be an optical sensor that images printed registration marks on the material to be cut. As the registration marks are sensed, the controller receives a signal from the sensor and the controller, through software, can determine whether adjustments to the cutting servo 224 need to be to ensure that the material is being cut at the correct locations. The sensors 118 can also include a press-feed sensor, i.e., a sensor that senses the speed of the material that is to be cut upstream of the cutter. The press-speed can then be used by the controller 210 to adjust the speed of the draw servo so that the draw servo rotates to match the press-speed. This ensures a smooth feed from the upstream into the cutter.

Figure 8:
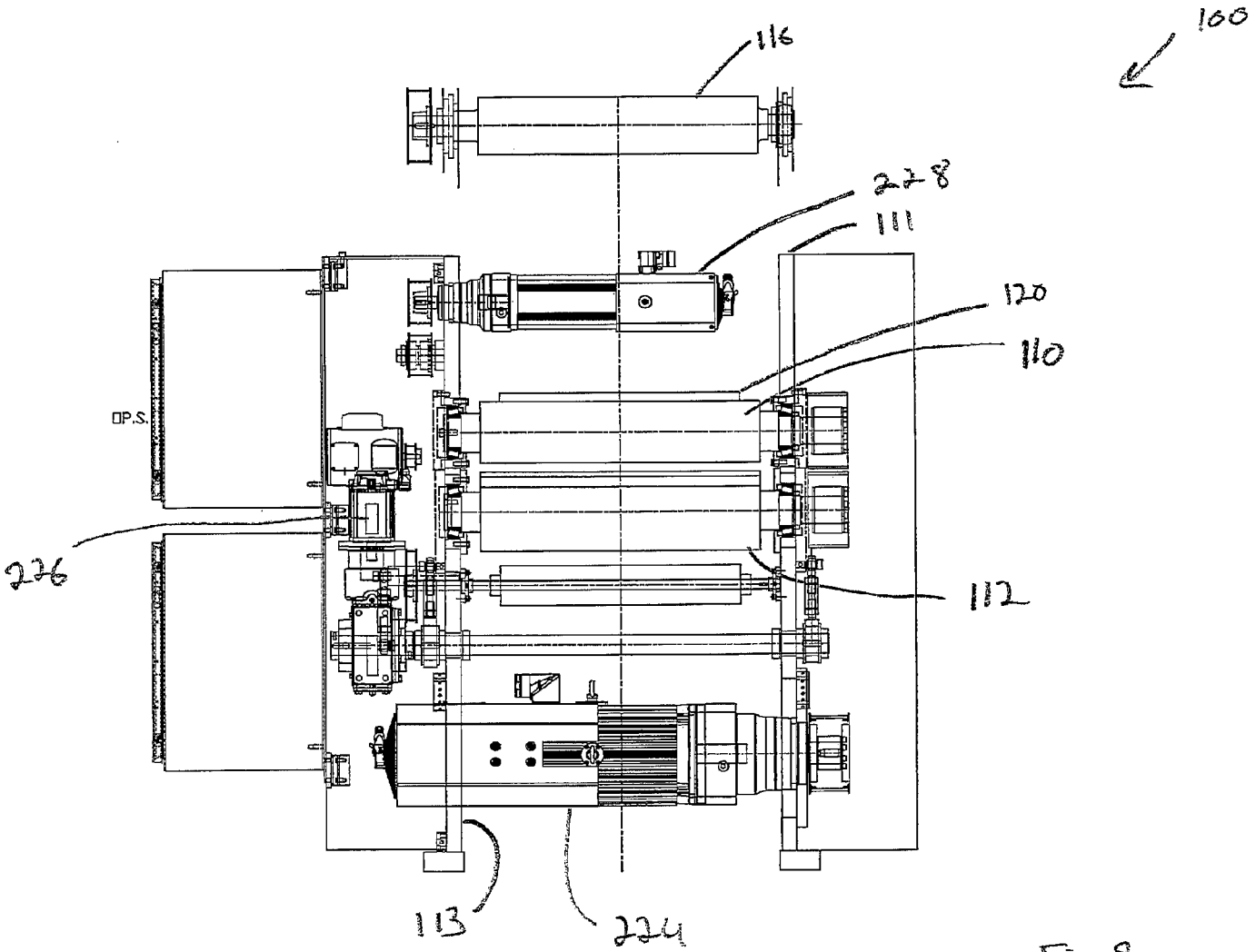
FIG. 8 is a front view of the cutter.
Figure 8:
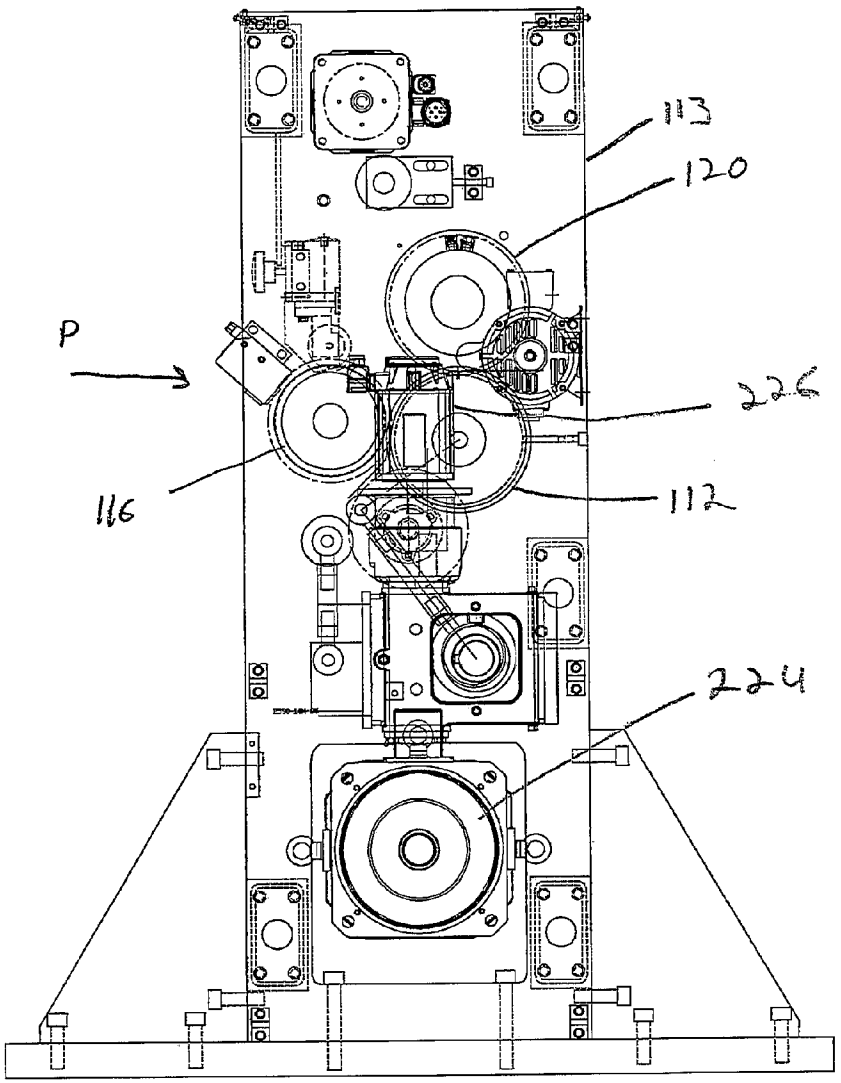
Figure 10:
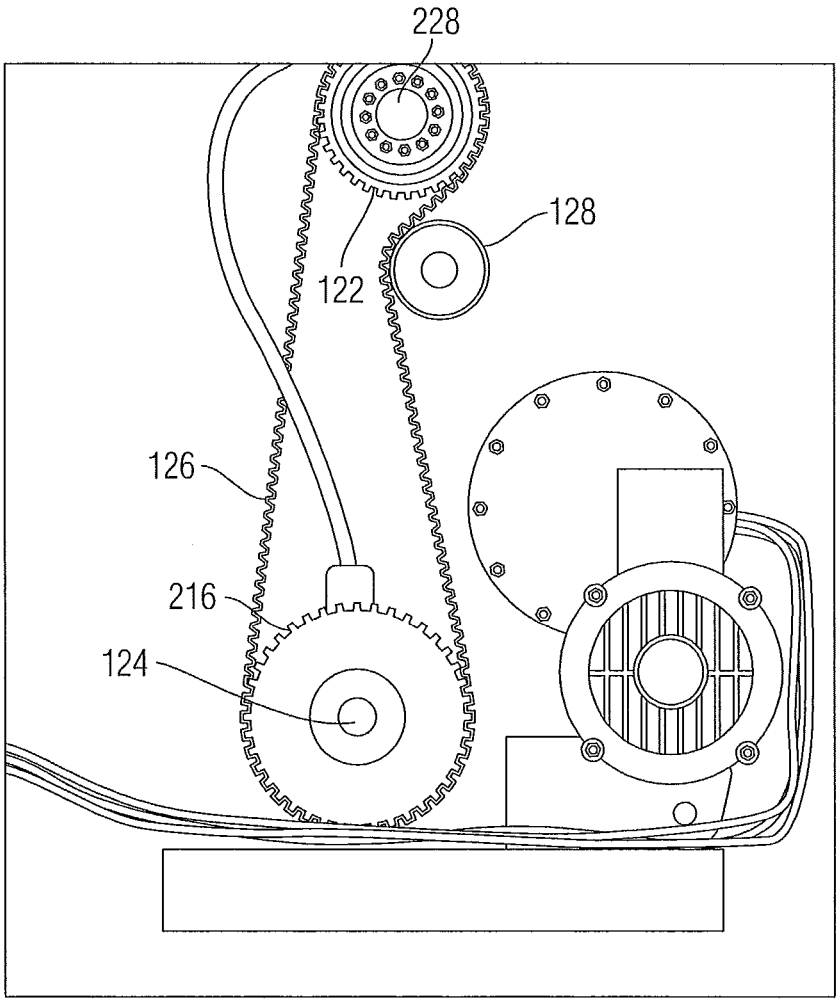
FIG. 10 is an image of the side view of the cutter along the B direction of FIG. 8.

Referring FIG. 7, the rotary cutter 100 includes a driven infeed draw roller 116. The material to be cut (arrow P) is feed over the top of the draw roller 116 (FIG. 8 shows the draw roller 116 out of position so that the cutting and anvil cylinders can be more clearly seen). The infeed draw roller and is controlled via a digital signal from the controller 210 through the drivers 220 that follows press speed of the material. The draw roller 116 is driven by the draw servo motor 228. The variable gain or tension can be adjusted by an operator using the interface 216 of the control system 200 to change the settings. As can be seen in FIG. 10, a pulley 122 is connected to the shaft of the draw servo 228 and a pulley 124 is connected to the shaft of the draw roller 116. A belt 126 is disposed around the pulleys so that the servo 228 can drive the draw roller 116. A tensioner 128 maintains tension on the belt 126. Four pneumatic trolleys 130 can be provided in conjunction with the draw roller 116 to assist with the feed of the material to be cut over the draw roller. The pulleys and belt are toothed so that there is not slippage which would cause timing issues. The pneumatic trolleys can be controlled using the interface 216.

After the material to be cut passes over the draw roller 116, it is passed between a cutting cylinder 110 and hardened anvil cylinder 112. The anvil cylinder 112 can include four fixed extractor pin positions spaced at 1" intervals that are used to remove material chips, i.e., scrap material that is disposed between two cut pieces of the material. The cutting cylinder 110 includes four fixed position knife holders 120 spaced at 90 degrees around the cylinder (only is shown in FIG. 7 for illustration purposes). The knife holders 120 are interchangeable and available in ¼", ½", and ¾" chip sizes. The knife holders are KRO style and use commercially available disposable knives.

The anvil cylinder 112 is mounted in eccentric housings driven by a height servo 226 through a 100:1 gearbox to adjust blade height. Controlling the servo 226 causes the anvil cylinder 112 to move within its eccentric housing so that the distance between the anvil cylinder 112 and the cutting cylinder 110 is adjusted either up or down.

Figure 11:
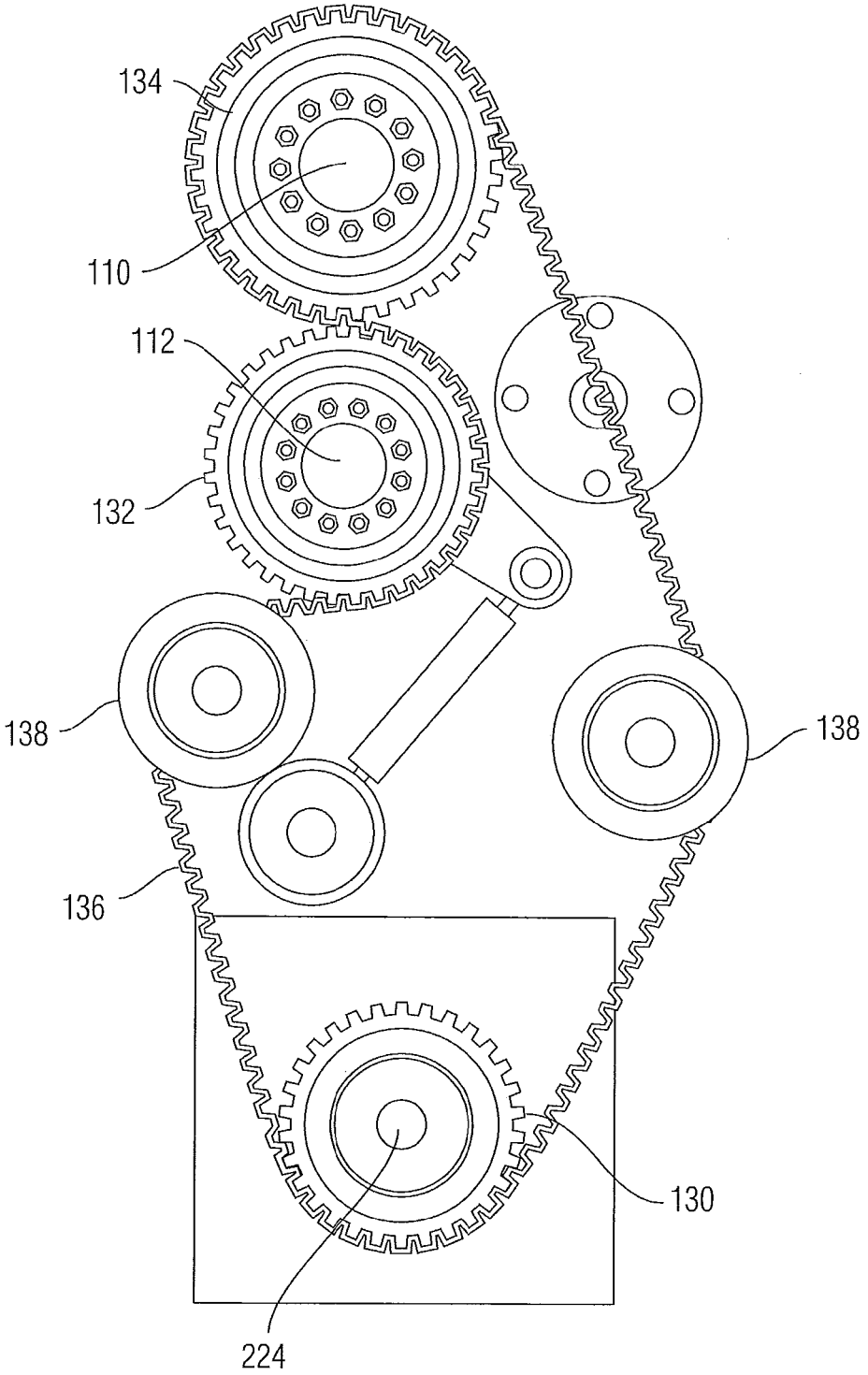
FIG. 11 is an image of the side view of the cutter along the A direction of FIG. 8.

Referring to FIG. 11, a pulley 130 is connected to the shaft of the cutting servo 224, a pulley 132 is connected to the shaft of the anvil cylinder 112, and a pulley 134 is connected to the shaft of the cutting cylinder 110. A toothed belt 136 is disposed around the pulleys 132, 134, and 136, as well as a pair of idler pulleys 138. Accordingly, the cutting servo 224 can drive the cutting and anvil cylinders 110, 112 via the belt 136.

The cutting and anvil cylinders 110, 112 are driven by the cutting servo 224 which is capable of cam profiling. Accordingly, the speed of the cylinder can be adjusted to adjust the size of the cut. For example, if the speed of the cylinders could not be adjusted, the size of the cut would be determined by the fixed location of the knives in the cutting cylinder. However, by adjusting the speed the size of the cut can be adjusted. As the cutting cylinder rotates, the knives come into contact with anvil cylinder which cuts the material that is being feed between the cutting cylinder and the anvil cylinder. As the cutting cylinder continues to rotate so that knife is not longer contacting the anvil cylinder, the material is free to pass between the cylinders at "press speed" (i.e., material feed speed) without being impeded by the knives in the cutting cylinder. As the cutting cylinder continues to rotate, the next knife comes into contact with the anvil cylinder forming another cut in the material. The amount of material that passes between the cylinders in between cuts defines the length of the cut material. Accordingly, by controlling the speed of the cylinders, the time interval between the successive knives coming into contact with the anvil can be adjusted. The longer time interval, the longer the cut length and the short the time interval, the shorter the cut length. The speed of the cutting and anvil cylinders should be brought back to "press speed" at the time the cut is made to ensure that the material to be cut does not bunch or jam. For example, at the time of the cut (knife/anvil contact), the cutting and anvil cylinders are rotating at press speed, then the cylinders are slowed down via the controller 210 controlling the servo 224. As the cylinders slow, material continues to pass between the cylinders, but as the next knife on the cutting cylinder rotates toward the anvil cylinder, the servo is sped up so that the cutting and anvil cylinders again match press speed. The cut size is controlled by the speed of the cylinders. Similarly, short cut lengths can be achieved by increasing the rotating speed of the cylinders between cuts, thereby making cuts more frequently so that a shorter length of material passes between the cylinders in between cuts. Accordingly, the cut size can be adjusted via use of the controller 210 without having to adjust the positioning of the knives on the cylinder every time the size of the cut needs to be changed. This substantially reduces the make-ready time of the rotary cutter 100 because the physical location of the knives around the cutting cylinder can be left in the same place even though the length of the cut is changed. The controlling of the speed to adjust the cut length is similar to that described in connection with FIGS. 1-5 above, except that the bottom cylinder 12 is replaced by the anvil cylinder 112 that does not include knives itself.

Make-ready is accomplished by entering the size of the product length (i.e., desired cut size) and chip size, (e.g., 0, ¼", ½", or ¾" chip) using the interface 216 and the controller 210 will automatically set the cutter servo 224 for the appropriate cam profile and locate appropriate knife positions (1, 2, 3, or 4 around).

The tail of the product is knocked by kicker brushes so the product is controlled by the tail as it enters the slow down delivery. The kickers are servo driven and can be phased to contact the tail of each sheet in the same position. The speed of the kickers can automatically set by the controller once the operators select product size. The slow down delivery is driven by a servo drive and the size of the shingle is adjusted from the operators touch screen.

The operators interface 216 (e.g. touch screen) has a run screen consisting of both net and gross counters, which adjust themselves for exact count by product size. The run screen also displays fast delivery over-speed, slow delivery shingle size, product size, gap size, and production speed in either FPM or IPH. The operators control has a make-ready section where the size of the product and gap are set. The operators control has a delivery set-up screen where the fast delivery speed, slow delivery speed, kicker position, and delivery interface options are set. The register screen includes manual register with quick moves for make-ready as well as automatic register with advance and retard buttons for both. The service set-up screen includes off-line and on-line controls; a batch count option, a top dead center adjustment, gap limit options, as well as options for ratio between press output and draw roll speed/ratio.

While the invention has been described in connection with a certain embodiment and variations thereof, the invention is not limited to the described embodiment and variations but rather is more broadly defined by the recitations in the claims below and equivalents thereof.

What is claimed is:

1. A rotary cutter system for cutting a web of material being fed into the rotary cutter at a press speed, comprising:

a cutting cylinder supported for rotation about an axis;

at least two knives mounted at spaced apart positions on the cutting cylinder and extending radially therefrom;

an anvil cylinder supported for rotation parallel to the axis and positioned such that the at least two knives contact the anvil cylinder at a cutting position in which each knife is perpendicular to the anvil cylinder;

at least one servo motor that rotates the cutting cylinder and the anvil cylinder; and a controller that includes a processor and memory and executing software that configures the processor to control the speed within a single rotation of the anvil cylinder and the cutting cylinder by controlling the at least one servo motor between a first speed that is equal to the press speed of the web that is passed between the cutting and anvil cylinders at the cutting position, thereby cutting the web that is disposed between the cutting and anvil cylinders, a second speed in which the web passes between the cutting and anvil cylinders without being cut to define a first length of a first cut, and a third speed in which the web passes between the cutting and anvil cylinders without being cut to define a second length of a second cut, wherein the speed of the cylinders is adjustable between the first, second, and third speeds so that a time interval between successive knives mounted on the cutting cylinder coming in contact with the anvil cylinder defines varying cut lengths within a single rotation of the cutting cylinder and the anvil cylinder, wherein the speed within a single rotation of the anvil cylinder and the cutting cylinder controls the length of a cut in the web of material and wherein the rotary cutting system is capable of cutting the web at least twice such that the length of the first and second cut pieces are different by varying the time interval between successive cuts within a single rotation of the cutting cylinder.

2. The rotary cutter system as in claim 1, further comprising two mounting walls and wherein the cutting cylinder is supported between the two mounting walls for rotation about the axis.

3. A rotary cutter system for cutting a web of material being fed into the rotary cutter at a press speed, comprising:

a first cylinder supported for rotation about a first axis;

at least two knives mounted at spaced apart positions on the first cylinder and extending radially therefrom;

a second cylinder supported for rotation about a second axis;

at least two knives mounted at spaced apart positions on the second cylinder and extending radially therefrom, wherein the first and second cylinders are positioned and radially oriented with respect to each other such that the at least two knives of the first cylinder contact the second cylinder at a cutting position in a location that does not interfere with the at least two knives of the second cylinder, and the at least two knives of the second cylinder contact the first cylinder at a cutting position in a location that does not interfere with the at least two knives of the first cylinder;

at least one servo motor that rotates the first and second cylinders; and a controller that includes a processor and memory and executing software that configures the processor to control the speed within a single rotation of the first and second cylinders by controlling the at least one servo motor between a first speed that is equal to the press speed of the web that is passed between the first and second cylinders at the cutting position, thereby cutting the web that is disposed between the cylinders, a second speed in which the web passes between the cylinders without being cut to define a first length of a first cut, and a third speed in which the web passes between the cylinders without being cut to define a second length of a second cut, wherein the speed of the cylinders is adjustable between the first, second, and third speeds so that a time interval between successive knives mounted on the first cylinder coming in contact with the second cylinder defines varying cut lengths within a single rotation of the first cylinder and the second cylinder, wherein the speed within a single rotation of the cylinders controls the length of a cut in the web of material and wherein the rotary cutting system is capable of cutting the web into at least two pieces such that the length of the first and second cut pieces are different by varying the time interval between successive cuts and into at least two chip pieces, wherein the chip pieces are have a length different from the first and second cut pieces within a single rotation of the first and second cylinders.

* * * * *